US009745970B2

(12) United States Patent
Sobol et al.

(10) Patent No.: US 9,745,970 B2
(45) Date of Patent: Aug. 29, 2017

(54) LINEAR PIEZOELECTRIC COMPRESSOR

(71) Applicant: Technion Research & Development Foundation Ltd., Haifa (IL)

(72) Inventors: Sergey Sobol, Haifa (IL); Gershon Grossman, Haifa (IL)

(73) Assignee: TECHNION RESEARCH & DEVELOPMENT FOUNDATION LTD., Haifa (IL)

( * ) Notice: Subject to any disclaimer, the term of this patent is extended or adjusted under 35 U.S.C. 154(b) by 196 days.

(21) Appl. No.: 14/412,939

(22) PCT Filed: Jul. 7, 2013

(86) PCT No.: PCT/IL2013/050582

§ 371 (c)(1),
(2) Date: Jan. 5, 2015

(87) PCT Pub. No.: WO2014/006628

PCT Pub. Date: Jan. 9, 2014

(65) Prior Publication Data

US 2015/0147207 A1 May 28, 2015

Related U.S. Application Data

(60) Provisional application No. 61/668,659, filed on Jul. 6, 2012.

(51) Int. Cl.
*F04B 25/02* (2006.01)
*F04B 17/00* (2006.01)
(Continued)

(52) U.S. Cl.
CPC ..... *F04B 17/003* (2013.01); *F04B 25/02* (2013.01); *F04B 35/04* (2013.01); *F04B 43/046* (2013.01);
(Continued)

(58) Field of Classification Search
CPC ..... F04B 17/003; F04B 45/047; F04B 25/02; F04B 43/046; F04B 35/04; F04B 2203/0406; F04B 2205/00
See application file for complete search history.

(56) References Cited

U.S. PATENT DOCUMENTS 5,779,149 A 7/1998 Hayes
2002/0025260 A1* 2/2002 Maruyama ..... F04B 17/003 417/322
(Continued)

FOREIGN PATENT DOCUMENTS

WO 2009010971 A2 1/2009

OTHER PUBLICATIONS

Gilbertson, et al., "A Survey of Micro-Actuator Technologies for Future Spacecraft Missions," Journal of the British Interplanetary Society, vol. 49, pp. 129138, 1996.
(Continued)

*Primary Examiner* — Peter J Bertheaud
*Assistant Examiner* — Dnyanesh Kasture
(74) *Attorney, Agent, or Firm* — McDonnell Boehnen Hulbert & Berghoff LLP

(57) ABSTRACT

A linear compressor employing a piezoelectric actuator operating in resonance at a frequency substantially below its natural resonant frequency, which is usually of the order of 10 kHz. Low frequency resonance operation of the actuator, of the order of 100 Hz., is achieved by incorporating the actuator and its housing with the moving compression piston, such that the moving mass is substantially increased, and by reduction of the effective piezoelectric stiffness using hydraulic amplification of the actuator displacement. Both these procedures result in a reduction of the actuator resonant frequency. The hydraulic amplification is achieved by using a hydraulic chamber with different sized pistons, linking the actuator motion with motion of the actuator housing, to which the compressor piston is attached. The high efficiency achieved and the lack of moving parts or the need for lubricating oil makes the compressor ideal for use in high reliability and high purity applications.

20 Claims, 3 Drawing Sheets

(51) Int. Cl.
*F04B 35/04* (2006.01)
*F04B 43/04* (2006.01)
*F04B 45/047* (2006.01)

(52) U.S. Cl.
CPC .... *F04B 45/047* (2013.01); *F04B 2203/0406* (2013.01); *F04B 2205/00* (2013.01)

(56) References Cited

U.S. PATENT DOCUMENTS

| | | | |
|---|---|---|---|
| 2006/0051232 | A1 | 3/2006 | Ooi et al. |
| 2007/0263887 | A1 | 11/2007 | Tanner |
| 2007/0273248 | A1 | 11/2007 | Wright |
| 2009/0311116 | A1 | 12/2009 | Bai et al. |

OTHER PUBLICATIONS

Sirohi et al., "Investigation of the Dynamic Characteristics of a Piezohydraulic Actuator," Journal of Intelligent Material Systems and Structures, vol. 16, pp. 481-492, 2005.
Sobol, et al, "A study of a miniature in-line pulse tube cryocooler," Cryocoolers, vol. 16, pp. 87-95, 2010.
Tan et al., "Performance Modeling of a Piezohydraulic Actuator with Active Valves," Smart Materials and Structures, vol. 14, pp. 91-110, 2005.
Wang, et al., "Dynamic modeling of thickness-mode piezoelectric transducer using the block diagram approach," Ultrasonics, vol. 51 pp. 617-624, 2011.

* cited by examiner

LINEAR PIEZOELECTRIC COMPRESSOR

This application is a U.S. National Phase of International Application No. PCT/IL2013/050582, filed Jul. 7, 2013, which claims priority to U.S. Provisional Application No. 61/668,659, filed Jul. 6, 2012, the disclosures of which are hereby incorporated by reference in their entireties.

FIELD OF THE INVENTION

The present invention relates to the field of miniature linear compressors, especially those based on piezoelectric elements and providing oil free operation.

BACKGROUND OF THE INVENTION

Mechanical fluid compressors are used in numerous fields, in many of which, maintenance of high purity levels of the compressed gas or pumped liquid is required. Applications with such requirements include medical applications, such as the provision of compressed gases for respiration support, or for anesthetic use, and cryogenic applications such as in cryo-coolers, where the presence of such contaminants as oil would severely interfere with the operation of the application.

Conventional compressors are classified into rotary and linear motor types. A rotary compressor generally has a shorter lifetime than a linear one due to wear of bearings and the increased piston-cylinder wear caused by radial forces applied by the crank shaft mechanism. Moreover, a rotary compressor produces a troublesome angular momentum, which is hard to eliminate or reduce. In order to increase the lifetime of a rotary compressor, the use of lubricating oil is essential, with its concomitant pollution potential in high purity compression applications. If such rotary compressors are operated without oil, the lifetime of the moving parts would be seriously curtailed. Additional disadvantages of such rotary compressors are heat generation, induced vibrations and noise. In cryogenic applications, the wear products of the moving parts and outgas sing of the lubricants also contaminate the working gas and thus degrade cryocooler performances. On the other hand, linear compressors, though less prone to the negative aspects of rotary compressors, have the disadvantages of lower efficiency, complicated electronic and control systems, and increased weight and volume, particularly because of the electronic drivers required to operate the linear motion generating element.

In the article entitled "A Survey of Micro-Actuator Technologies for Future Spacecraft Missions" by R. G. Gilbertson and J. D. Busch, published in "Journal of The British Interplanetary Society", Vol. 49, pp. 129138, 1996, a survey is presented of ten different methods applicable to miniature actuators for transforming energy into motion. According to that survey, piezoelectric devices exhibit the highest efficiency, fastest speed of operation and highest power density relative to other methods. These advantages make piezoelectric devices potentially attractive for implementation in miniature gas compressors. Furthermore, the lack of rotating parts increases their reliability compared with conventional rotary compressors, this being an important feature in medical uses, and in military uses, such as in cryocooler compressors for low-temperature infrared detectors.

The major problem in employing piezoelectric elements as compressor actuators is the extremely small elongation of the piezo materials, typically about 0.1% of the total actuator length, and thus of the order of microns in standard piezo actuators, such as those of Lead Zirconate Titanate (PZT), which is probably the most widely used piezoelectric material, and which will be used as the example material in this disclosure. Such small strokes create technological problems to implement, associated with the dimensional and geometry tolerances, surface finishing, structure stiffness and more. Another significant disadvantage of the PZT actuators is the low power density and electromechanical efficiency achievable from piezoelectric elements when operated at the "low" frequencies required for practical compressor operation, which are typically in the range of a few tens to a few hundred Hz. For instant a Stirling-type cryocooler based on piezoelectric elements should operate in the frequency range of 50-150 Hz. However, direct quasistatic wave generation using piezoelectric actuators at such low frequencies is extremely inefficient. At these frequencies, about 90% of the PZT charge is wasted, mostly because of the elasticity of the PZT ceramic itself. To improve the efficiency of a piezoelectric compressor, it is essential to operate the PZT element at its mechanical resonance, and since the natural frequency of PZT stack actuators is generally of the order of tens of kHz, a mechanism must be found for reducing the resonant frequency by about two orders of magnitude.

High frequency piezoelectric compressors incorporating a frequency reduction mechanism with a complex hydraulic transmission system have been reported. However, even in such systems, the piezoelectric element cannot be operated at a frequency as high as its natural resonance, due to frequency limitations of the check valves used in the hydraulic transmission system and the high hydraulic losses at such frequencies.

Some of the problems arising from piezoelectric/hydraulic systems have been considered in a number of prior art publications, including in International Patent Application published as WO 2009/010971 for "Piezo-Hydraulic Compressor/Pressure Oscillator for Cryogenic Cooling and other Applications" to the applicant of the present application; the article entitled "Performance Modeling of a Piezohydraulic Actuator with Active Valves, by H. Tan et al., in Smart Materials and Structures, Vol. 14, pp. 91-110 (2005) published by IOP Publishing of Bristol, U.K.; in the article entitled "Investigation of the Dynamic Characteristics of a Piezohydraulic Actuator" by J. Sirohi et al., in "Journal of Intelligent Material Systems and Structures", Vol. 16, pp. 481-492 (June 2005), published by Sage Publications of London EC1, UK; and in references cited in those various publications.

There therefore exists a need for a linear piezoelectric compressor which overcomes at least some of the disadvantages of prior art systems and methods.

The disclosures of each of the publications mentioned in this section and in other sections of the specification, are hereby incorporated by reference, each in its entirety.

SUMMARY

The present disclosure describes new exemplary piezoelectric compressor systems, which enable the piezoelectric actuator to operate at a resonance with its concomitant high efficiency, yet at a frequency sufficiently low to be useful for direct implementation in a linear compressor system operating in the region of hundreds of Hz.

The nature of the resonant operation of a PZT element can be considered from two fundamental approaches—electrical and mechanical—since both types may be considered to maximize the useful electromechanical efficiency of the PZT actuator. Operation at electrical resonance implies use of a particular RLC circuit, which should recover the electrical charge of the PZT, and thus minimize the power consumption. Operation at mechanical resonance, on the other hand, maximizes the mechanical output by means of recovering the potential mechanical energy stored in the system. Therefore, despite the equivalency of the methods in terms of the electromechanical efficiency, operation in mechanical resonance yields much higher power density, and thus is superior. However, forcing a PZT actuator to operate at resonance two or more orders of magnitude below its natural frequency is not a simple task.

The natural frequency f, of any mechanical system is proportional to the square root of the effective stiffness k, divided by the appropriate mass m, thus: $f \alpha \sqrt{k/m}$.

In the systems described in this disclosure, in order to reduce the resonance frequency, both elements of this relationship are dealt with by separate constructional features of the compressor, thereby providing a novel linear compressor, having significant advantages over prior art linear compressors, as follows:

(i) In order to reduce the effective stiffness k of the PZT assembly, a stroke amplification system is used, since amplification of the PZT displacement reduces the effective stiffness of the PZT assembly by a factor equal to the square of the amplification ratio. The resonant frequency, being proportional to the square root of the stiffness, is therefore reduced by a factor directly proportional to the amplification ratio.

(ii) In order to increase the mass m of the compressing piston, which is the operational element of the linear compressor, the mass of the PZT ceramic driving element itself and the mass of the PZT housing are added to that of the vibrating piston itself. The resonant frequency is therefore reduced by a factor proportional to the square root of the mass increase ratio.

In the compressor configurations described in this disclosure, the stroke amplification is achieved by using a form of hydraulic amplification, such as is known in the art, for instance in U.S. Pat. No. 5,779,149 to E. J. Hayes Jr, for "Piezoelectric Controlled Common Rail Injector with Hydraulic Amplification of Piezoelectric Stroke". In the present described systems, this is achieved by installing the piezoelectric actuator in its rigid housing with one end abutted against the end of the housing, and the other end driving a hydraulic piston which compresses a hydraulic fluid contained within a hydraulic volume contained within the rigid housing. The pressure within that hydraulic volume operates on another smaller area piston, which is rigidly attached to a fixed outer housing, such that as the hydraulic pressure pushes on the smaller piston, the whole of the actuator rigid housing is pushed away from that fixed smaller piston. Because of the relative area of the two pistons, the virtual movement of the smaller piston—which, being fixed, transfers its virtual movement to the rigid housing in whose hydraulic volume it is installed—is larger than that of the larger piston according to the ratio of the areas of the pistons. The double piston hydraulic system thus operates as the desired motion amplifier, thereby achieving the aims set out in paragraph (i) above. One aspect in which this hydraulic amplification system differs from prior art hydraulic amplification in that the hydraulically amplified motion is used to provide increased stroke motion back to the driving actuator housing itself, as opposed to prior art systems, where the driven element is generally a piston which itself in endowed with the amplified motion. Finally, the end of the rigid housing against which the actuator abuts is equipped with a third piston, which acts as a compressor piston in the hydraulic compression chamber.

At the same time, the piezoelectric actuator is firmly affixed to its rigid housing and hence also to the compressor piston, and is also attached to the larger area piston. Consequently, the effective mass of the piezoelectric actuator, with all these added elements is considerably larger than that of the actuator itself. This increase in mass is effectively operative in fulfilling the requirements of paragraph (ii) above.

There is thus provided in accordance with an exemplary implementation of the devices described in this disclosure, a linear compressor comprising:

(i) a piezoelectric actuator installed within a housing, with a first end of the actuator attached to a first end of the housing, (ii) a motion amplifying assembly having an input end driven by the second end of the piezoelectric actuator, in fluid communication with its output end, adapted to provide a motion greater than that of the second end of the piezoelectric actuator, (iii) a static outer envelope coupled to the housing at the output of the motion amplifying assembly, and (iv) a compression piston attached to the first end of the housing, such that when the piezoelectric actuator undergoes a predetermined vibrational motion, the motion amplifying assembly causes the housing to undergo, relative to the static outer envelope, vibrational motion at a level greater than that of the predetermined vibrational motion.

In such a linear compressor, the motion amplifying assembly may comprise:

(i) a hydraulic volume formed at a second end of the housing, the hydraulic volume having a bore having a cross section at a first end proximate the piezoelectric actuator, larger than its cross section at its second, output end, (ii) a first piston disposed in the bore at its first end, (iii) a piston shaped abutment attached to the static outer envelope, disposed in the bore at its second, output end, and (iv) hydraulic fluid filling the hydraulic volume such that vibrational motion of the first piston generates magnified vibrational motion of the bore over the piston shaped abutment.

Furthermore, the outer envelope may comprise a compression chamber into which the compression piston fits, such that vibrational motion of the housing generates concomitant vibrational motion of the compression piston in the compression chamber.

In any such linear compressors, the attachment of the housing and of the first piston and of the compression piston to the piezoelectric actuator is configured to increase the effective mass of the piezoelectric element, such that its mechanical resonant frequency is reduced from that of the piezoelectric actuator when unattached. Furthermore, the combination of increased effective mass together with the vibrational motion at a level greater than that of the predetermined vibrational motion should reduce the mechanical resonant frequency of the piezoelectric element installed within its housing, from that of the piezoelectric actuator when unattached. Additionally, the hydraulic volume may advantageously comprise a stepped cylindrical chamber having a larger diameter at the end attached to the piezoelectric actuator, than the diameter at the output end remote from the piezoelectric actuator. The resulting linear compressor should have an effective resonant frequency substantially less than the free resonant frequency of the piezoelectric actuator. In any of these above described linear compressors, the lack of rotating parts enables the compressor to operate without the need for lubricants.

Additionally, alternative implementations of any of the above-described systems may further involve a linear compressor comprising:

(i) a piezoelectric actuator installed within a housing, with a first end of the actuator attached to a first end of the housing, (ii) a hydraulic volume formed at a second end of the housing, the end of the hydraulic volume proximal to the piezoelectric actuator installed within the housing having a larger cross sectional area than the end remote from the piezoelectric actuator, (iii) a first piston attached to the second end of the actuator, and adapted to slide within the end of the hydraulic volume having a larger cross sectional area, (iv) a second piston disposed within the end of the hydraulic volume remote from the piezoelectric actuator, the second piston abutting against a first end of an outer envelope in which the housing is disposed, and (v) a third piston fixed to the first end of the housing, and adapted to slide within a hydraulic compression chamber formed within the second end of the outer envelope.

In such an alternative implementation, the abutting of the second piston against a first end of the outer envelope maintains the second piston in a static position, such that increase of pressure within the hydraulic volume generates motion of the housing over the static second piston. In such a case, the motion of the housing generates motion of the third piston in the compression chamber. Furthermore, the larger cross sectional area of the end of the hydraulic volume proximal to the piezoelectric actuator should enable generation of a larger motion of the second piston relative to the hydraulic volume than the motion of the first piston in the hydraulic volume. In any of these linear compressors, the attachment of the housing and of the first piston and of the third piston to the piezoelectric actuator is configured to increase the effective mass of the piezoelectric element, such that its mechanical resonant frequency is reduced from that of the unattached piezoelectric actuator. In all such linear compressors, the hydraulic volume may comprise a stepped cylindrical chamber having a larger diameter at the end proximal to the piezoelectric actuator, than the diameter at the end remote from the piezoelectric actuator.

Another example implementation can involve a linear compressor comprising:

(i) a housing having a compression piston at a first end and a hydraulic bore with a first piston adapted to slide within the bore at a second end, the cross sectional area of the bore at its end remote from the interior of the housing being smaller than its cross section adjacent the inside of the housing, (ii) a piezoelectric actuator installed within the housing, with its first end attached to the first end of the housing, and its second end attached to the first piston, and (iii) a second piston in fluid communication with the first piston, and having a cross section smaller than that of the first piston, disposed in the remote section of the bore, and attached to a first end of an outer envelope in which the housing can move longitudinally, the second end of the outer envelope having a compression chamber in which the compression piston is disposed.

In such a linear compressor, the smaller cross section of the second piston compared to that of the first piston is adapted to generate motion of the housing larger than the motion of the piezoelectric actuator attached to the first piston. Additionally, the attachment of the housing and of the first piston and of the compression piston to the piezoelectric actuator should increase the effective mass of the piezoelectric element, such that its mechanical resonant frequency is reduced from that of the unattached piezoelectric actuator.

Additionally, alternative implementations of any of the above-described systems may further involve a linear compressor comprising:

(i) a static outer envelope having a compression chamber at a first end and a static piston abutment at its second end, (ii) a housing installed within the outer envelope, a first end of the housing having a compressor piston and a second end having a bore with ends of different cross sections, such that as the housing moves within the outer envelope, the compression piston slides within the compression chamber and the bore slides over the static piston abutment, and (iii) a piezoelectric actuator installed within the housing, a first end of the actuator being attached to the first end of the housing, and a second end of the actuator being attached to a first piston adapted to slide within an end of the bore having a larger cross section than that end which slides over the static piston abutment.

In such a linear compressor, the fact that the actuator is attached to a first piston adapted to slide within the end of the bore having a larger cross section than that end of the bore which slides over the static piston abutment, enables the generation of motion of the housing larger than the motion of the actuator attached to the first piston. In either of the preceding described linear compressors, the attachment of the housing and of the first piston and of the compression piston to the piezoelectric actuator is configured to increase the effective mass of the piezoelectric element, such that its mechanical resonant frequency is reduced from that of the unattached piezoelectric actuator.

Still other example implementations involve a method of activating a piezoelectric actuator, comprising:

(i) providing a housing with the actuator installed therein with a first end attached to a first end of the housing, and a second end attached to a first piston which can slide within a bore within the second end of the housing, the remote end of the bore containing a second piston having a cross section smaller than that of the first piston, the first and the second pistons being in hydraulic communication, and the second piston being attached to an outer envelope in which the housing can move longitudinally, and (ii) applying a periodically varying voltage to the piezoelectric actuator, the voltage being such that the actuator would vibrate with a first amplitude, the vibration being transferred to the first piston which compresses the hydraulic fluid and causes the housing to vibrate with an amplitude magnified from that of the first amplitude, wherein combination of the magnified vibration amplitude, and the attached mass of the housing and the first piston to the piezoelectric actuator causes the piezoelectric actuator to vibrate at a frequency below its own natural mechanical resonance frequency.

In this method, the housing may have attached to its first end, a compression piston which slides within a compression chamber at the end of the outer envelope opposite to that of the second piston, such that the vibration of the piezoelectric actuator causes the compression piston to vibrate within the compression chamber. Combination of the steps of either of these methods enables the compressor to operate at a frequency substantially lower than the natural mechanical resonance frequency of the piezoelectric actuator.

Finally, although the structures, methods and typical dimensions used in the construction and operation of the piezoelectric linear compressor proposed in the present disclosure, are in some places described as applicable for use with a Stirling-type cryocooler, it is to be understood that this is only one exemplary use of such systems, and the application is not intended to be limited to this application, but is applicable to any linear compressor of any suitable dimensions in other applications and sizes also.

BRIEF DESCRIPTION OF THE DRAWINGS

The present invention will be understood and appreciated more fully from the following detailed description, taken in conjunction with the drawings in which.

DETAILED DESCRIPTION

Figure 1:
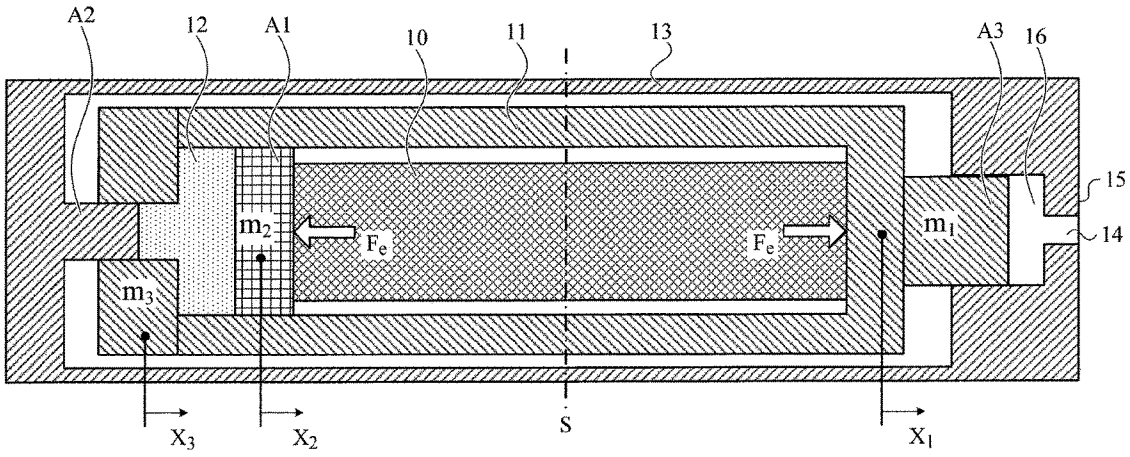
FIG. 1 illustrates schematically one exemplary implementation of a linear compressor employing a drive mechanism of the type described in this disclosure.

Reference is now made to FIG. 1, which illustrates schematically one exemplary implementation of a linear compressor employing a drive mechanism of the type described in this disclosure. The internal parts of the compressor are contained within a rigid outer envelope 13, which can have any cross section but is most conveniently cylindrical in shape. The PZT actuator stack 10 is contained within its own rigid housing 11 disposed inside the outer envelope 13, and is attached firmly at a first end of the stack, shown as the right hand end in FIG. 1, to a first end of the rigid housing 11. The opposite, second end of the PZT actuator is attached to a moving piston marked as A1 and having an area A1, sliding within a hydraulic chamber 12 at the opposite, second end of the rigid housing 11. On application of the activating electric field (not shown in FIG. 1), the PZT actuator 10 oscillates lengthwise, and at each lengthening of the actuator during its piezoelectric oscillation, the piston A1 compresses the hydraulic fluid contained within the hydraulic chamber 12. The diameter of the hydraulic chamber 12 is reduced at its end remote from the piston A1, to a region of smaller cross section, and is closed at that remote end by another piston A2, having an area A2 which is smaller than the area of piston A1. The compressing motion of piston A1 is transferred to piston A2 by means of the hydraulic fluid filling the hydraulic chamber 12 between the two pistons. The smaller area piston, A2, is rigidly attached at the end opposite to the hydraulic chamber to one end (the left hand end in FIG. 1) of the static outer envelope of the compressor 13, which is designated as the second end. The compressor outlet port 14 is situated at the opposite, first end of the static outer envelope 13, most conveniently in its end wall 15. A third piston, marked A3, slides in a compression chamber 16 in that end wall 15. The third piston A3 is rigidly attached to the first end of the PZT rigid housing 11, which is that end opposite to the end attached to the piston A1. Since the PZT actuator 10 is attached rigidly to that first end, the piston A3 undergoes the same displacement as that of the first end of the PZT actuator. As the PZT rigid housing 11 oscillates, the piston A3 thus generates pressure oscillations in the compression chamber 16.

It is to be emphasized that although the smaller area piston A2 is essentially a static abutment rigidly attached to the left-hand, second end of the static outer envelope, and hence does not undergo spatial motion with respect to the compressor, since it undergoes relative motion to the bore of the hydraulic space by means of sliding motion of the chamber over the static piston, it is designated "a piston" in this disclosure, and is thuswise claimed, even though a conventional piston is generally understood to be a moving element in a static cylinder.

In operation, the PZT actuator 10 produces an internal force, $F_e$, at both ends in the axial direction, proportional to the applied voltage. As a result, the PZT ceramic tends to elongate, and the movement of the A1 piston causes the volume of the hydraulic chamber 16 to decrease. In the absence of an external load, reduction of the hydraulic volume 16 must be compensated for by motion of the A2 piston in the same direction as the motion of the A1 piston, but by a displacement larger than that of the A1 piston by a factor A1/A2. However, since piston A2 is firmly attached to the rigid outer envelope, which is assumed to be static by virtue of its attachment to the system in which the compressor is installed, increase in the length on the A2 end of the fluid in the hydraulic chamber 12 is possible only by displacement of the entire PZT rigid housing 11 in the opposite direction, which is to the right in FIG. 1. Movement of the rigid housing 11 causes the piston A3 to move in its own compression chamber 16 by an equal amount, and since piston A3 is the compressing element of the system, the result is an amplified motion of the moving part of the compressor, as compared with the motion of the piezoelectric actuator itself. This amplified motion is associated with reduced stiffness of the PZT assembly by a factor equal to the square of the amplification ratio—$(A1/A2)^2$. Thus, one aspect of the achievement of a reduction of the resonant frequency of the piezoelectric element has been achieved by the device of FIG. 1.

However, not only has the device thus succeeded in decreasing the stiffness of the PZT element, but increase of the effective mass also results from this arrangement. The moving part of the compressor shown in the implementation of FIG. 1 contains several masses connected together, namely the PZT actuator 10, the PZT rigid housing 11, piston A1 and piston A3, together with their various attachment hardware. All of these component parts may thus be considered as a single vibrating moving part of significantly increased mass over that of the PZT actuator itself. This increased mass vibration element is attached to the static rigid envelope 13 of the compressor by two supporting springs—the gas spring of the load into which the compressor is operating through the compressor output port 14, and the stiffness measured at the A2 piston. Ideally, the latter should be equal to the stiffness of the PZT stack divided by the square of the amplification ratio $(A1/A2)^2$.

Therefore, by selecting an appropriate ratio A1/A2 together with a relatively large moving mass, resonance operation of the PZT actuator assembly can be achieved at frequencies substantially lower than the natural frequency of the PZT itself, thereby substantially increasing the suitability and efficiency of piezoelectric linear compressor systems.

Figure 2A:
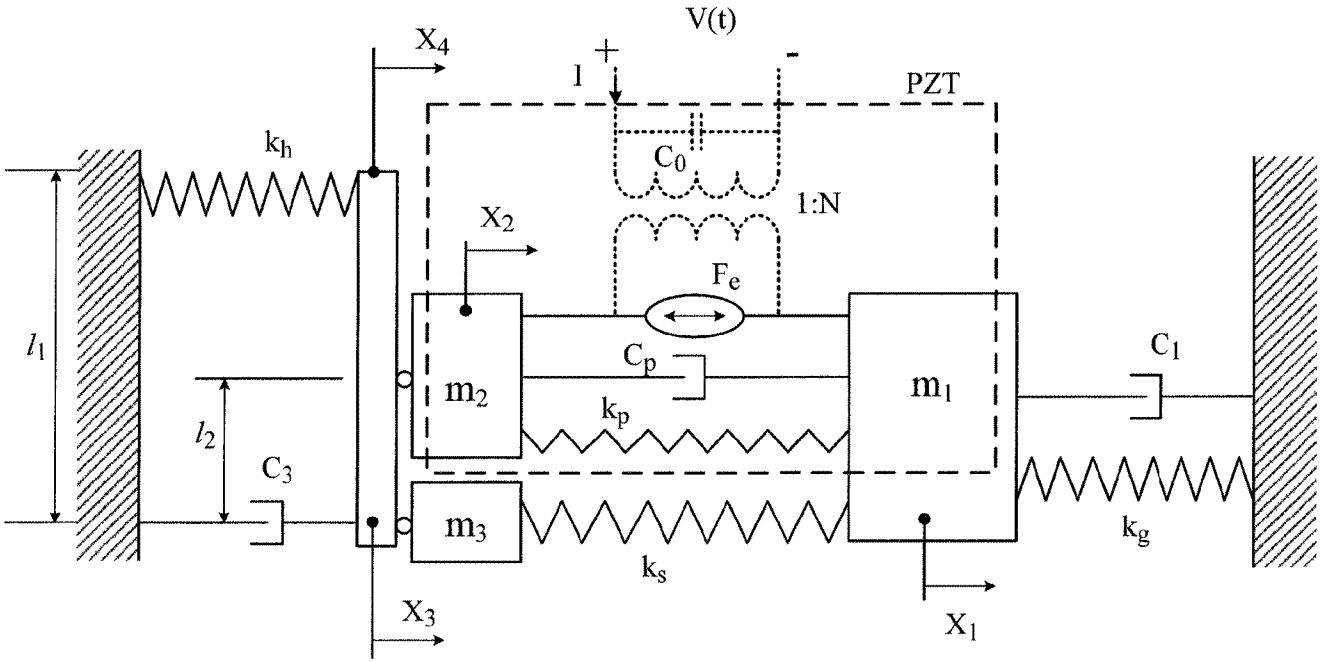
FIGS. 2A and 2B illustrate schematically a theoretical model of the elastic dynamic motion system of the linear compressor device shown in FIG. 1.
Figure 2B:
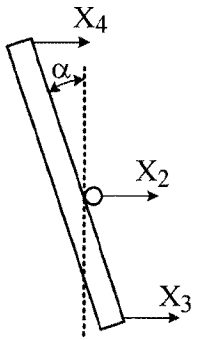

Reference is now made to FIGS. 2A and 2B, which illustrate schematically a theoretical model of the elastic dynamic motion system of the linear compressor device of FIG. 1. FIG. 2A shows a schematic three mass model of the proposed linear compressor, based on an analytical spring-mass-damper model developed to describe the dynamic motion of the system. Practically, the stiffness measured at the piston A2 contains some additional in-series spring constants, such as the stiffness of the amplification system, the elasticity of the PZT housing and non-ideal mechanical contacts. These secondary springs may have a significant impact on the compressor dynamics, and thus, must be considered in the design.

The continuous mechanism of the compressor is split into three moving parts, by the section line S shown on FIG. 1, to obtain a three-degrees-of-freedom model. According to the nomenclature of the coordinates shown in FIG. 1, the right-hand part of the PZT actuator 10 combined with the right-hand part of the PZT housing 11 is denoted as the first model mass, namely $m_1$; the left-hand part of the actuator 10 together with the piston A1 becomes $m_2$, and the left-hand part of the PZT housing 11 becomes $m_3$. The third mass $m_3$ is connected with $m_1$ through the structural spring $k_s$, which defines the stiffness of the PZT housing. Damper $c_3$ is connected to $m_3$ in order to simulate possible friction between the housing and piston A2.

The hydraulic amplification system is assumed compressible, and is represented by a rigid mechanical lever with hydraulic spring $k_h$ connected to the static envelope as shown on the left-hand side of FIG. 2A, and as shown in FIG. 2B with the lever in a deflected mode. The no-load amplification ratio, a, is presented by means of the lever lengths, namely:

$$a=11/12=A1/A2.$$

The external system to which the compressor is supplying the compressed gas, is assumed to apply a two component load on the compressor, namely a gas spring $k_g$ and a damper $c_1$. Both components are attached to $m_1$ in parallel. Physical interpretations of the gas and hydraulic springs are given by Equations (1) and (2) respectively:

$$k_g = \frac{\gamma P_{g0} A_3^2}{V_{g0}} \tag{1}$$

$$k_h = \frac{K A_2^2}{V_{h0}} \tag{2}$$

where γ, $P_{g0}$ and $V_{g0}$ are respectively, the adiabatic constant, the filling pressure and the mean volume of the gas being compressed; K and $V_{h0}$ are the bulk modulus and the mean volume of the liquid. The amount of the liquid compression is expressed by vector $x_4$, shown in FIGS. 2A and 2B, according to Equation (3):

$$x_4 = \frac{V_h - V_{h0}}{A_2} \tag{3}$$

In order to estimate the current behavior in the vicinity of the resonance frequency, the PZT model integrates both mechanical and electrical aspects of the PZT properties. The piezoelectric actuator, schematically bounded by a dashed line in FIG. 2A, can be modeled as consisting of part of mass $m_1$ and $m_2$ connected by the PZT stack stiffness $k_P$ and the mechanical damper $c_P$. The force generator is embedded into an electrical circuit through the electromechanical converter with symmetric coefficient N. The converter is supplied with an external alternating voltage V in parallel with the PZT capacitor $C_0$. This formalism is explained in the article by N. Setter, "ABC of Piezoelectricity and Piezoelectric Materials", Proceeding of the International Conference on Piezoelectric Materials for End Users, Interlaken, Switzerland (2002), and the article by S-H. Wang, et al, entitled "Dynamic modeling of thickness-mode piezoelectric transducer using the block diagram approach", published in Ultrasonics, Vol. 51 pp. 617-624 (2011).

The constitutive equations of the piezoelectric stack in the present system have the following form, omitting the irreversibilities:

$$\begin{cases} A_1 P_h = k_P(x_1 - x_2) - NV \\ Q = N(x_1 - x_2) + C_0 V \end{cases} \tag{4}$$

where Q is the PZT charge, and the product NV, denoted in FIG. 2A by $F_e$, is the PZT force generated by the inverse piezoelectric effect. Differentiation with respect to time of the second equation in set (4) provides a differential equation for the PZT current:

$$I = N(\dot{x}_1 - \dot{x}_2) + C_0 \frac{dV}{dt} \tag{5}$$

Motion equations of the proposed model may be obtained using the Euler-Lagrange method. Three independent vectors $x_1$, $x_2$ and a are chosen for the solution. Relations of $x_3$ and $x_4$ to the independent vectors are given in equation (6) and as illustrated in FIG. 2B. The angle α is assumed to be small enough to enable the vertical displacement of vectors $x_3$ and $x_4$ to be ignored.

$$\begin{cases} x_3 = x_2 + l_2 \sin\alpha \\ x_4 = x_2 - (a-1) l_2 \sin\alpha \end{cases} \tag{6}$$

The Lagrangian and the dissipation functions of the mechanical system are presented in Equations (7) and (8) respectively. Solution of the Euler-Lagrange equations is given in (9)

$$L = \frac{1}{2}m_1\dot{x}_1^2 + \frac{1}{2}m_2\dot{x}_2^2 + \frac{1}{2}m_3(\dot{x}_2 + l_2\dot{\alpha}\cos\alpha)^2 - -\frac{1}{2}k_g x_1^2 - \frac{1}{2}k_P(x_1 - x_2)^2 - \frac{1}{2}k_s(x_1 - x_2 - l_2\sin\alpha)^2 - \frac{1}{2}k_h(x_2 - (a-1)l_2\sin\alpha)^2 \tag{7}$$

$$D = \frac{1}{2}c_1\dot{x}_1^2 + \frac{1}{2}c_P(\dot{x}_1 - \dot{x}_2)^2 + \frac{1}{2}c_3(\dot{x}_2 + l_2\dot{\alpha}\cos\alpha)^2 \tag{8}$$

-continued $$\begin{cases} m_1\ddot{x}_1 + (c_1 + c_P)\dot{x}_1 - c_P\dot{x}_2 + (k_P + k_s + k_g)x_1 - (k_P + k_s)x_2 - k_s l_2 \sin\alpha = NV \\ (m_2 + m_3)\ddot{x}_2 + m_3 l_2\ddot{\alpha}\cos\alpha - c_P\dot{x}_1 + (c_P + c_3)\dot{x}_2 + c_3 l_2\dot{\alpha}\cos\alpha - m_3 l_2\dot{\alpha}^2\sin\alpha - \\ \quad -(k_P + k_s)x_1 + (k_P + k_s + k_h)x_2 + (k_s - (a-1)k_h)l_2\sin\alpha = -NV \\ m_3\ddot{x}_2\cos\alpha + m_3 l_2\ddot{\alpha}\cos^2\alpha + c_3\dot{x}_2\cos\alpha + c_3 l_2\dot{\alpha}\cos^2\alpha - m_3 l_2\dot{\alpha}^2\cos\alpha\sin\alpha - \\ \quad -k_s x_1\cos\alpha + (k_s - (a-1)k_h)x_2\cos\alpha + (k_s + (a-1)^2 k_h)l_2\cos\alpha\sin\alpha = 0 \end{cases} \tag{9}$$

The motion equations thus obtained can be linearized by assuming $\alpha$ to be close to zero. Thus, terms in (9) that include $\alpha^2$ or its derivatives may be omitted, and $\sin\alpha$ and $\cos\alpha$ are replaced by $\alpha$ and 1 respectively. As a result a linear set of the motion equations is obtained, which in matrix form is given in equation (10):

$$\begin{bmatrix} m_1 & 0 & 0 \\ 0 & m_2 + m_3 & m_3 \\ 0 & m_3 & m_3 \end{bmatrix}\begin{bmatrix} \ddot{x}_1 \\ \ddot{x}_2 \\ l_2\ddot{\alpha} \end{bmatrix} + \begin{bmatrix} c_1 + c_P & -c_P & 0 \\ -c_P & c_P + c_3 & c_3 \\ 0 & c_3 & c_3 \end{bmatrix}\begin{bmatrix} \dot{x}_1 \\ \dot{x}_2 \\ l_2\dot{\alpha} \end{bmatrix} + + \tag{10}$$

$$\begin{bmatrix} k_P + k_s + k_g & -(k_P + k_s) & -k_s \\ -(k_P + k_s) & k_P + k_s + k_h & k_s - (a-1)k_h \\ -k_s & k_s - (a-1)k_h & k_s + (a-1)^2 k_h \end{bmatrix}\begin{bmatrix} x_1 \\ x_2 \\ l_2\alpha \end{bmatrix} = \begin{bmatrix} NV \\ -NV \\ 0 \end{bmatrix}$$

Equations (10) and (5) together with relations (6), in which $\sin\alpha$ is replaced with $\alpha$, are assumed to fully describe the dynamics of the proposed linear compressor model. Equations (10) are independent of relations (5) and (6), and thus, can be solved separately for any form of the supplied voltage V(t). Solutions for (5) and (6) can be obtained thereafter.

Example

Figure 3:
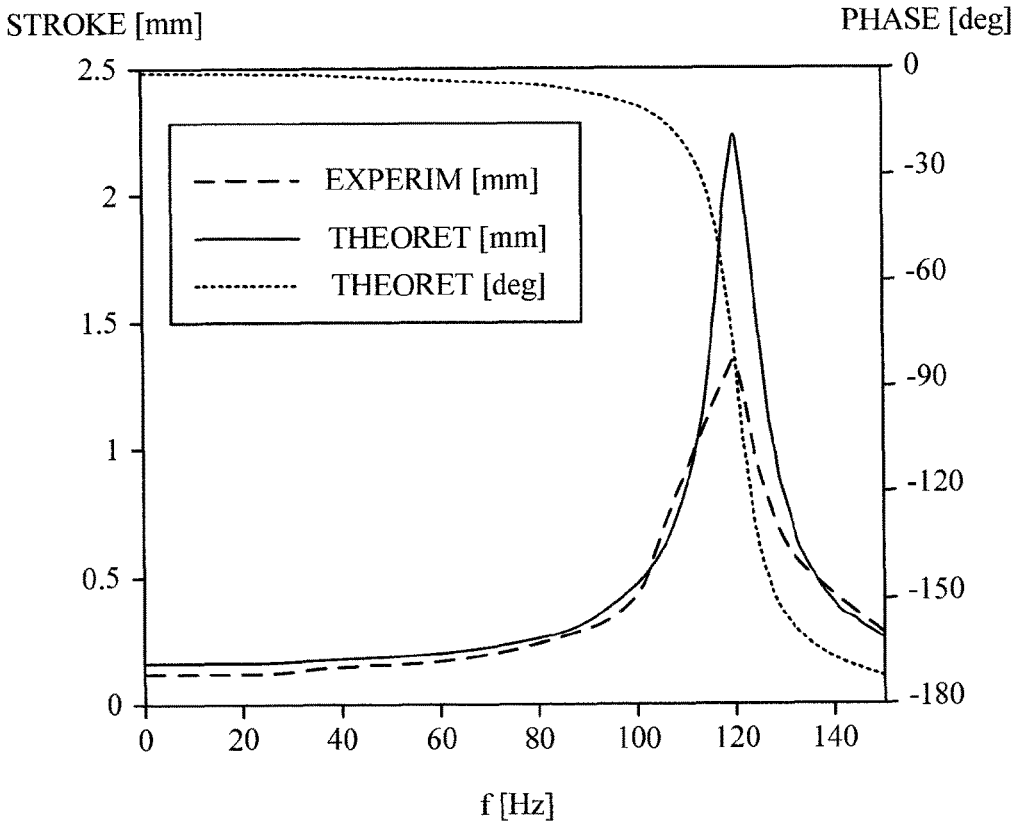
FIG. 3 is a graphical representation of the results of an exemplary piezoelectric linear compressor unit, constructed using to the structures and methods described in FIGS. 1 and 2A-2B.

Reference is now made to FIG. 3 which is a graphical representation of the operating results of an exemplary piezoelectric linear compressor unit, constructed using the structures and methods described in FIGS. 1 and 2A-2B of the present disclosure. The graph shows the experimental and theoretical frequency responses of a linear compressor mechanism, constructed to demonstrate the validity of the structures and methods described hereinabove. The sample linear compressor was constructed around a high voltage stack PZT actuator, model No. P-016.40, supplied by Physik Instrumente (PI) GmbH & Co. of Karlsruhe, Germany with 60 μm elongation, 100 N/μm stiffness, and 680 nF capacity.

The compressor parameters were chosen to fulfill the requirements to act as the compressor of a miniature pulse tube cryocooler, such as is described in the article titled "A study of a miniature in-line pulse tube cryocooler" published in Cryocoolers, Vol. 16, pp. 87-95 (2010) by the present applicants and another. The cryocooler operates at approximately 100 Hz, and requires a filling pressure of 40 Bar and a pressure ratio of 1.3. The effective mean volume of the cryocooler is about 0.7 cc. Assuming a 12 mm diameter compression piston with 1 mm stroke the mean compression volume increases up to 0.76 cc, and according to Equation (1), the gas spring constant becomes 113 N/mm.

Pure water was used for the amplifying system liquid in this experimental compressor, since it possesses relatively high bulk modulus and is bio and chemically friendly. The relatively high viscosity of the water has a minor effect on the system dynamics because of the very small strokes. The fluid volume was minimized in order to increase the hydraulic spring constant according to equation (2).

Selection of the A1 piston diameter is restricted by the PZT parameters and the hydraulic pressure, since the dynamic operation of the PZT stack actuator must be accompanied by application of a specific preload on the piezoelectric stack. According to recommendations of the manufacturer of the stack used, the mean preload should result in half the maximum allowable PZT shrinkage, which is about 30 μm in the case of the selected element. Assuming a mean hydraulic pressure of 50 Bar, a 28 mm. diameter A1 piston was used.

In contrast to the A1 piston, selection of the A2 piston diameter is more arbitrary, and depends mostly on the required amplification ratio, which in turn strongly affected the resonance frequency. Unfortunately, according to Equation (2), A2 strongly affects the hydraulic spring constant also. Therefore, establishing a larger amplification ratio implies the softening of the hydraulic spring, and in case of a springy load, results in a less effective amplification system. A trade-off is therefore necessary between these two conflicting requirements, and in accordance with preliminary simulations employing the theoretical model, a 6.5 mm A2 piston diameter was used as a compromise.

Referring back again to FIG. 3, the results were plotted and calculated for a 200V peak to peak sine-wave driving voltage, in the range of frequencies up to 150 Hz. Numerical values used in the simulations are the following: a=18.56, $m_1$=0.25 kg, $m_2$=0.05 kg, $m_3$=0.25 kg, ks=480 N/μm, $k_P$=100 N/μm, $k_h$=1,222 N/mm, kg=113 N/mm, $c_1$=20 Ns/m, $c_3$=5 Ns/m, $c_P$=1000 Ns/m, $C_0$=680 nF, N=6 N/V.

The left ordinate shows the compressing piston stroke, as represented by $X_1$, while the right ordinate show the phase of the compressor piston relative to that of the voltage applied to the PZT stack.

As is observed from the experimental and theoretical results shown in FIG. 3, the PZT mechanism together with the PZT actuator entered their resonance mode at the relatively low frequency of 120 Hz, which provided both maximum amplitude of the gas load spring and current phase very close to the theoretical expected behavior. Relative to the quasistatic mode, the x1 compressor piston stroke obtained was amplified 11.4 times in resonance, namely from 0.12 mm to 1.37 mm, and the PZT elongation amplitude increased 2.9 times, namely from 9.4 to 27.4 micrometers.

From a comparison of the results shown in FIG. 3, it is clear that the analytical linear spring-mass-damper model of the drive mechanism is validated, and shows a good qualitative and numerical agreement with the obtained results. The model correctly predicted the intended main resonance frequency and, qualitatively, the system operating parameters, despite some inaccuracy in their values, mainly in the amplitudes, though not by an unreasonable amount, considering the complexity of the model and the assumptions made. In the resonance vicinity the main reason for the decreased amplitudes of the constructed sample relative to the theoretical model appears to be the nonlinear behavior of the structural stiffness, which may drop at low hydraulic pressures. Since the pressure varies with high amplitude in this region, the actuator-to-housing coupling loses its intensity as the pressure drops, and the PZT does not receive a sufficient impact by the system. This can be avoided by raising the initial amplifier pressure, which involves some changes in the system design. Another possible reason for the discrepancies between the model and the example is the linear approximation of the actual parameters.

According to further developments of such systems, it is feasible to construct a no-moving-parts linear compressor because of the relatively low amplitudes used. This enables the replacement of the piston-cylinder assemblies with flexural bearings and membrane seals. Additionally, an in-line configuration of the compressor consisting of two oppositely facing PZT based compression units is proposed, which should reduce the amplitudes even more, and, additionally should eliminate the vibration levels. The high efficiency together with a no-moving-parts design can enable the double piston piezoelectric compressor to replace conventional linear compressors, for applications requiring long life, reliability and silent operation.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

We claim:

1. A linear compressor comprising:

a static outer envelope having a compression chamber formed at a first end and a piston shaped abutment at its second end;

a housing installed within said static outer envelope, a piezoelectric actuator being installed within said housing, with a first end of said actuator attached internally to a first end of said housing;

a motion amplifying assembly attached to the second end of said piezoelectric actuator, said motion amplifying assembly adapted to provide motion of the entire housing, relative to said piston abutment, that is greater than a corresponding motion of said second end of said piezoelectric actuator;

and a compression piston attached externally to said first end of said housing;

such that when said piezoelectric actuator undergoes a predetermined vibrational motion, said motion amplifying assembly causes the entire housing and its attached compression piston to undergo, relative to said static outer envelope, vibrational motion at a level that is greater than that of said predetermined vibrational motion.

2. A linear compressor according to claim 1, wherein said motion amplifying assembly comprises:

a hydraulic volume formed at a second end of said housing, said hydraulic volume having a bore having a cross section at a first input end proximate said piezoelectric actuator, larger than its cross section at its second, output end;

a first piston disposed in said bore at its first input end, said first piston being attached to said second end of said actuator; and said piston shaped abutment attached to said static outer envelope, disposed in said bore at its second, output end, such that when said hydraulic volume is charged with hydraulic fluid, vibrational motion of said first piston generates magnified vibrational motion of said bore over said piston shaped abutment.

3. A linear compressor according to claim 2 wherein said compression piston fits into said compression chamber, such that vibrational motion of said housing generates concomitant vibrational motion of said compression piston in said compression chamber.

4. A linear compressor according to claim 2 wherein said hydraulic volume comprises a stepped cylindrical chamber having a larger diameter at said end attached to said piezoelectric actuator, than the diameter at the output end remote from said piezoelectric actuator.

5. A linear compressor according to claim 1 wherein the attachment of said housing and of said first piston and of said compression piston to said piezoelectric actuator is configured to increase the effective mass of said piezoelectric element, such that its mechanical resonant frequency is reduced from that of said piezoelectric actuator when unattached.

6. A linear compressor according to claim 5 wherein said combination of said increased effective mass together with said vibrational motion at a level greater than that of said predetermined vibrational motion reduces the mechanical resonant frequency of said piezoelectric element installed within its housing, from that of said piezoelectric actuator when unattached.

7. A linear compressor according to claim 1 wherein said device has an effective resonant frequency less than the free resonant frequency of said piezoelectric actuator.

8. A linear compressor according to claim 1 wherein said compressor lacks rotating parts, thereby enabling said compressor to operate without the need for lubricants.

9. A linear compressor comprising:

a piezoelectric actuator installed within a housing, with a first end of said actuator attached to a first end of said housing internally;

a hydraulic volume formed at a second end of said housing, a first end of said hydraulic volume proximal to said piezoelectric actuator having a cross sectional area larger than the second end of said hydraulic volume remote from said piezoelectric actuator;

a first piston attached to the second end of said actuator, and adapted to slide within said first end of said hydraulic volume;

a second piston in hydraulic contact with said second end of said hydraulic volume, said second piston being connected internally to a first end of a static outer envelope in which said housing is disposed; and a third piston fixed externally to said first end of said housing, and adapted to slide within a hydraulic compression chamber formed internally within the second end of said static outer envelope;

wherein said first end of said hydraulic volume having a cross sectional area that is larger than the second end of said hydraulic volume comprises a motion amplifying assembly, which causes the entire housing including its third piston to undergo, relative to said static outer envelope, vibrational motion at a level that is greater than a vibrational motion of said piezoelectric actuator.

10. A linear compressor according to claim 9 wherein said internal connection of said second piston to said first end of said static outer envelope maintains said second piston in a static position, such that increase of pressure within said hydraulic volume generates motion of said housing over said second piston.

11. A linear compressor according to claim 10 wherein said motion of said housing generates motion of said third piston in said compression chamber.

12. A linear compressor according to claim 9 wherein said larger cross sectional area of said end of said hydraulic volume proximal to said piezoelectric actuator is adapted to generate a larger motion of said second piston relative to said housing than the motion of said first piston relative to said housing.

13. A linear compressor according to claim 9, wherein the attachment of said housing and of said first piston and of said third piston to said piezoelectric actuator is configured to increase the effective mass of said piezoelectric element, such that its mechanical resonant frequency is reduced from that of said piezoelectric actuator when unattached.

14. A linear compressor according to claim 9, wherein said hydraulic volume comprises a stepped cylindrical chamber having a larger diameter at said end proximal to said piezoelectric actuator, than the diameter at the end remote from said piezoelectric actuator.

15. A method of activating a piezoelectric actuator, comprising:

providing a housing with said actuator installed therein with a first end of said actuator attached internally to a first end of said housing, and a second end of said actuator attached to a first piston which can slide within a bore within the second end of said housing, the end of said bore remote from said first piston having a cross section that is less than that of said end of said bore proximal to said first piston, and containing a second piston having a cross section that is smaller than that of said first piston, said first and said second pistons being hydraulically connected, and said second piston being attached internally to a first end of a static outer envelope in which the entire housing can move longitudinally, said first end of said housing further having a third, external piston which can slide within a compression chamber formed at the second end of said outer envelope; and applying a periodically varying voltage to said piezoelectric actuator such that it undergoes vibration, said voltage being such that said actuator, if unloaded, would vibrate with a first amplitude, said vibration being transferred to said first piston which compresses a hydraulic fluid contained within said bore, and causes the entire housing to vibrate with an amplitude that is magnified from that of said first amplitude, wherein combination of said magnified vibration amplitude, and the attached mass of said housing and said first piston and said third piston to said piezoelectric actuator causes said piezoelectric actuator to vibrate at a resonant frequency that is below its own natural unloaded mechanical resonance frequency.

16. A method according to claim 15 wherein said vibration of said piezoelectric actuator causes said compression piston to vibrate within said compression chamber with an amplitude that is larger than that of said piezoelectric actuator.

17. A method according to claim 15, wherein attachment of said second piston to said static outer envelope generates motion of said housing in a reverse direction to that of motion of said first piston.

18. A method according to claim 15, wherein said third piston sliding within said compression chamber enables said piezoelectric actuator to deliver compressed fluid.

19. A method according to claim 15, wherein the absence of rotating parts enables said compressed fluid to be delivered without the need for lubricants.

20. A method according to claim 15, wherein attachment of said second piston to said static outer envelope renders said second piston also to be static, such that increased pressure within said bore generates longitudinal motion of said housing relative to said static second piston.

* * * * *